United States Patent [19]

Caron et al.

[11] Patent Number: 4,930,754

[45] Date of Patent: Jun. 5, 1990

[54] SECURITY RAILING

[76] Inventors: John L. Caron, 215D Denny Way, El Cajon, Calif. 92020; Frederic Hoffmanns, 1485 Central Street, Merritt Island, Fla. 32957

[21] Appl. No.: 290,590

[22] Filed: Dec. 27, 1988

[51] Int. Cl.[5] ..... E04H 17/14

[52] U.S. Cl. ..... 256/65; 256/66; 256/19; 256/72; 256/22

[58] Field of Search ..... 256/64, 65, 66, 59, 256/72, 19, 22

[56] References Cited

U.S. PATENT DOCUMENTS

| | | | |
|---|---|---|---|
| 3,868,630 | 2/1975 | Lesondak | 256/64 |
| 4,053,140 | 10/1977 | Clemens | 256/19 |
| 4,383,676 | 5/1983 | Souza Jr. | 256/22 |
| 4,403,767 | 9/1983 | Basey | 256/67 |
| 4,461,461 | 7/1984 | Caron | 256/19 |
| 4,610,432 | 12/1986 | Lewis et al. | 256/65 |
| 4,722,514 | 2/1988 | Pettit | 256/19 |

*Primary Examiner*—Randolph A. Reese
*Assistant Examiner*—Carol I. Bordas
*Attorney, Agent, or Firm*—Macdonald J. Wiggins

[57] ABSTRACT

A security railing is formed from thick wall polyvinyl chloride pipe (PVC) having PVC tee, cross and elbow fittings providing flush joints. A PVC joint aligner and strengthener is inserted in and extends across each joint, The joints and aligners are chemically welded to form a unitary structure. Joint aligners may include a steel core.

10 Claims, 1 Drawing Sheet

SECURITY RAILING

BACKGROUND OF THE INVENTION

1. Field of the Invention

The present invention relates to security railings for balconies, stairs, and the like and more particularly to an improved plastic railing which will meet building codes.

2. Description of the Prior Art

With the present trend toward multistory condominium and apartment buildings having balconies, there is a need for a security railing formed from non-corrosive materials. It has been found that metallic security railings which have been constructed from iron, steel, aluminum or the like have a short life in buildings exposed to polluted air and for buildings in coastal areas exposed to the corrosive effect of the salt water atmosphere. To maintain such metallic security railings in safe condition, continuous maintenance is required for removing rust and corrosion, and for refinishing of the railings. Where such maintenance is neglected, such railings can quickly become unsafe and dangerous.

There have been attempts in the prior art to develop reinforced non-metallic structures suitable for railings. For example, U.S. Pat. No. 4,181,764 to Totten, a rail is disclosed having a wooden core with a weather and abrasion resistant outer coating. However, a plurality of valve means must be proven for releasing vapor from the core yet preventing passage of water into the core. Furthermore, the strength of the Totten rail is determined by the wood core. To obtain the necessary strength for a building security railing, is is considered that the resulting structure would be too bulky and unattractive. Murphy in U.S. Pat. No. 3,957,250 teaches a fence post fabricated from tubular plastic material and filled with semi-rigid or rigid foam for additional strength. However, the posts appears to be suitable only for stringing of wire fencing. The U.S. Pat. No. 4,053,140 to Clemens, et al. shows a non-corrosive plastic handrail system designed for use in industrial applications along stairways, platforms, and the like to eliminate the corrosion problems due to electric currents and fields as well as corrosive environments. The strength of the handrail system described depends upon the use of a special thermosetting resin in which high tensile strength reinforcing fibers have been incorporated as taught by U.S. Pat. No. 3,859,409. Such specialized material is expensive and the patent does not disclose any testing of strength to determine if the material would satisfy building codes for balcony railings in apartment buildings and the like.

U.S. Pat. No. 4,461,461 to Caron introduced a laminated railing formed from polyvinyl chloride pipe which has solved many of the problems with known prior art security railings. The present invention represents an improvement over the Caron railing by eliminating the necessity for laminated pipe as will be described hereinafter.

SUMMARY OF THE INVENTION

The present invention is a security railing formed predominately from polyvinyl chloride (PVC) pipe which has the advantages of being lightweight, low cost, and non-corrosive. Furthermore, the railing in accordance with the invention will withstand significant deformation yet will return to its original shape when the load is removed.

A balcony railing or the like is constructed in accordance with the invention to have a relatively normal appearance. For example, there will be a plurality of upright posts which may be attached to the building floor in any conventional manner such as by flanges, anchoring in the concrete, or the like. It is preferred to anchor a steel pipe or bar into a concrete deck with PVC pipe placed over the steel pipe and extending into the concrete. A top PVC rail is provided coupled to the vertical posts by suitable T or cross couplings. Similarly, a lower PVC rail is provided coupled to the vertical posts by cross coupling. Disposed vertically between the upper and lower rails between the posts is a plurality of smaller rail elements closely spaced in a conventional pattern.

In accordance with the invention, the top rail sections and the vertical posts are formed of thick wall polyvinyl chloride (PVC) pipes. In a preferred embodiment of the invention, the pipe is 1.93 inches outside diameter and 1.3125 inches inside diameter. Each end of the pipe has a rabbet which forms a snug fit into the joints as described below.

Advantageously, the rails, in accordance with the invention, are joined using T, cross or elbow fittings. Each joint of a T or cross fitting is counterbored to complement the rabbeted ends of the rail sections and vertical posts and, when joined, provides a smooth joint with the same outside diameter as the rail or post. A joint aligner, which may be solid or tubular, having an outside diameter equal to the inside diameter of the rails and posts is inserted through each joint, extending about 2 inches beyond the joint. The joint aligners may be formed of solid PVC or may be PVC with a steel rebar embedded therein. The joints and aligners are fused together by use of PVC cement.

The vertical rail elements between the posts may be ½ inch diameter PVC pipes spaced about 6 inches apart and installed in holes drilled along the top and bottom railing.

It has been found that a spacing of posts of about 4 feet provides the required strength.

The PVC pipe utilized to form the rails of the invention may be obtained in a variety of finishes and colors. Thus, the security railing of the invention can be made very attractive and requires essentially no maintenance.

A typical railing section in accordance with the invention meets the requirement of Southern Building Code, Section 1204, Special Load 1204.2-Railing. The railing may deflect from a load and the railing will assume its original shape after removing the load with no permanent deformation.

It is therefore a primary object of the invention to provide a security railing for balconies and the like which is low cost, non-corrosive, and will meet established building codes.

It is another object of the invention to provide a security railing in which the main members thereof are formed from PVC pipes having reinforcing PVC joint aligners at each joint.

It is yet another object of the invention to provide a plastic pipe security railing which requires little maintenance and which can withstand loads specified by building codes.

It is still another object of the invention to provide a PVC security railing which may be fabricated in a variety of colors.

It is a further object of the invention to provide rails for a security railing formed from tubular PVC pipe having rabbeted ends mating with counterbored PVC fittings.

These and other objects and advantages of the invention will become apparent from the following detailed description when read in conjunction with the drawings.

DETAILED DESCRIPTION OF THE PREFERRED EMBODIMENT

Figure 1:
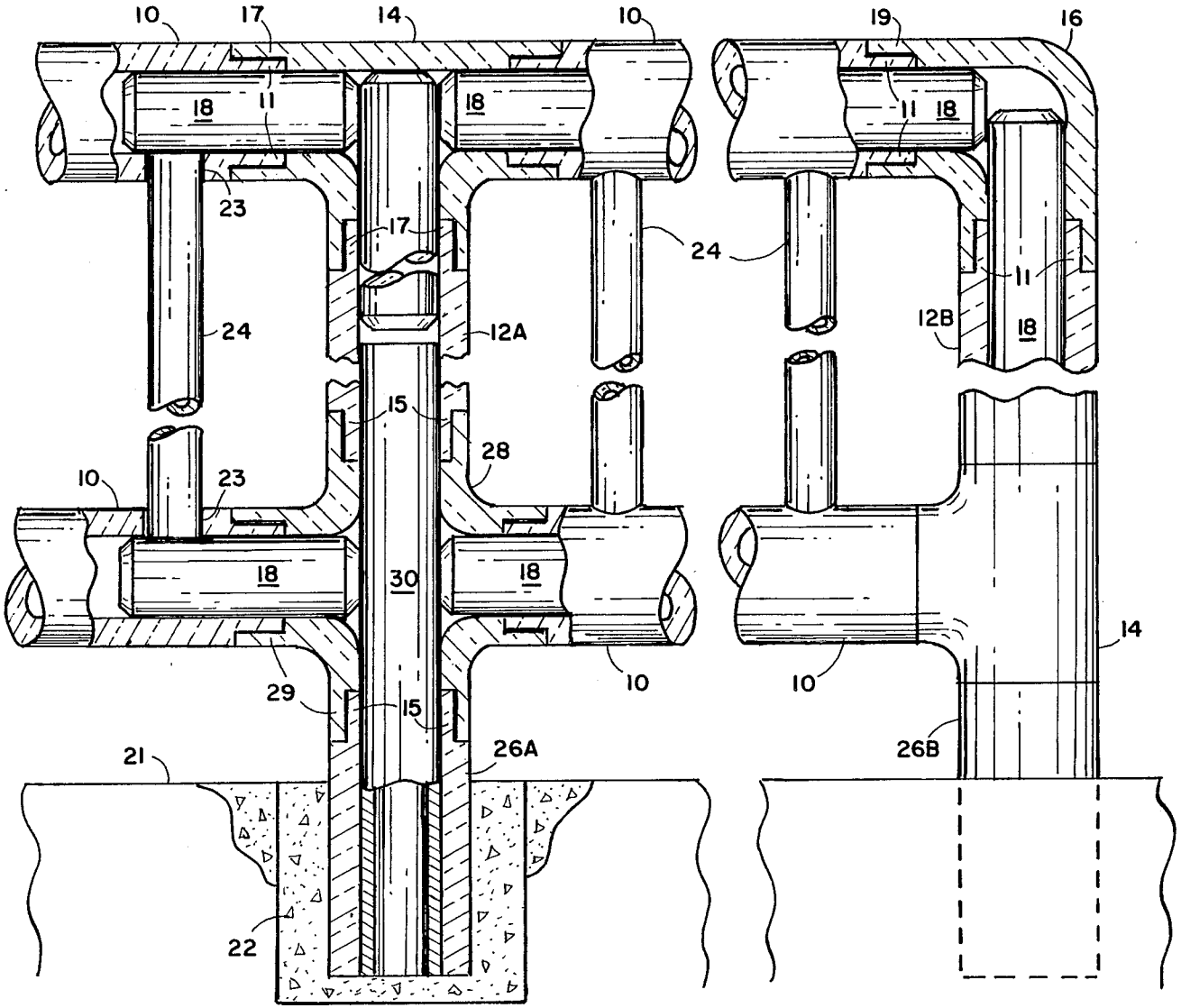
FIG. 1 is an elevation view of a security railing portion in accordance with the invention showing typical posts, rails and fittings in cross section.

In FIG. 1, a portion of a security railing in accordance with the invention is shown with a T-fitting 14, a cross fitting 28 and an elbow fitting 16 shown in cross section. Horizontal upper and lower rails 10 are formed from polyvinyl chloride (PVC) pipe. Each end of each rail 10 includes a rabbet 11 which mates with complementary counterbores 15, 19, or 29 of T-fittings 14, elbow fittings 16, and cross fittings 28. The inside and outside diameters of the tee fittings 14 and cross fittings 28 are the same as those of the rails 10. Connections are chemically welded with suitable PVC solvent or the like so as to form a unitary structure. As is well known in the art, a PVC solvent, when applied to two PVC surfaces to be joined, partially melts the surfaces causing them to fuse together as the solvent evaporates. This construction provides smooth, flush joints between the fittings and rail sections 10. The size and thickness of the pipe and fitting walls are selected in accordance with the load requirements. A 1.93 inch outside diameter and a 1.3125 inch inside diameter is preferred.

Vertical posts 12 and 26 are formed from the same PVC pipe material as rails 10. Posts 12 and 26 include rabbets 15 to couple with counterbores 17, 29 and 19.

Each post, rail and fitting joint is aligned and reinforced by use of joint aligners 18.

Joint aligners 18 are cylindrical and may be formed from solid or tubular PVC. Aligners 18 have an outer diameter to provide a snug fit in rails 10, posts 12 and fittings 14, 16 and 28. Joints are formed by coating first ends of aligners 18 with PVC solvent or the like and inserting aligners 18 into T-fittings 14, cross-fittings 28 and elbow fittings 16 as shown in cross sectional view in FIG. 1. The counterbores 17, 19 and 29, and the exposed ends of aligners 18 are coated with PVC solvent as rails 10 and posts 12, 26 are coupled to the fittings.

As will be noted, posts 26A and 26B are anchored in concrete deck 21 by anchor grout 22 as seen in the cutaway portion of deck 21. To reinforce posts 12A, 26A, and cross fitting 28, a steel pipe 30 having an outside diameter equal to the inside diameter of the posts and fittings is utilized and extends from the lower end of post 26A through cross-fitting 28 and into post 12A.

Figure 2:
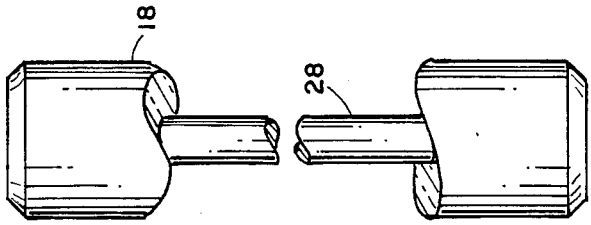
FIG. 2 is a cutaway view of an alternative joint aligner construction for the railing of FIG. 1.

Joint aligners 18 may be made in any desired length as required to extend for at least 2 inches across the various joints in a complete railing. An alternative construction of joint aligner 18 is shown in FIG. 2. Aligner 18 is shown cutaway to expose a steel reinforcing bar 28 embedded along the axis thereof. Bar 28 will add additional bending strength to aligner 18.

Vertical railing elements 24 may be formed from PVC ½ inch diameter pipe and cemented in openings 23 in horizontal rails 10. Six inch spacing of railing elements 24 is suitable.

As will now be recognized, an improved safety railing has been disclosed that is free from corrosion, that can be provided in any desired color, and that includes reinforced joints to provide sufficient strength to meet building codes. Although specific structures have been shown for exemplary purposes, various modifications may be made without departing from the spirit and scope of the invention.

I claim:

1. A security railing comprising:

(a) a plurality of horizontal rails formed of polyvinyl chloride cylindrical pipe, each of said rails having rabbeted ends thereof;

(b) a plurality of vertical posts formed of polyvinyl chloride cylindrical pipe, each of said elements having at least one rabbeted end thereof and having outer and inner diameters equal to the outer and inner diameters of said rails;

(c) a plurality of fittings having outer and inner diameters equal to the outer and inner diameters of said rails and posts, said fittings for joining said horizontal rails and said vertical posts to thereby form a security rail section; and (d) a plurality of cylindrical joint aligners formed of a solid cylinder of polyvinyl chloride having an outside diameter equal to the inside diameter of said rails, said posts, and said fittings, one of said joint aligners disposed in and through each of said fittings to extend across each joint formed with a rail or post, said joint aligners functioning to align and reinforce each joint formed between said fittings and said rails and posts.

2. The railing as defined in claim 1 in which said railing section includes a top rail and at least one lower rail.

3. The railing as defined in claim 2 in which said railing section includes a plurality of vertical closely-spaced rail elements attached between said top rail and a lower rail.

4. The railing as defined in claim 2 in which said fittings include tee fittings, cross-fittings, and elbow fittings.

5. The railing as defined in claim 4 in which lower ends of at least some of said vertical post elements are embedded in grout in a concrete slab, said lower ends and said cross-fittings have a steel pipe having an outside diameter equal to the inside diameter of said vertical post element and said steel pipe extending from said lower ends thereof through said cross-fitting.

6. The railing as defined in claim 1 in which each of said joint aligners include a metal reinforcing bar embedded therein.

7. A security railing section comprising:

a horizontal top rail formed of polyvinyl chloride pipe;

a horizontal lower rail formed of polyvinyl chloride pipe, and having outer and inner diameters equal to the outer and inner diameters of said top rail;

a tee fitting formed of polyvinyl chloride having outer and inner diameters equal to the outer and inner diameters of said rails, said tee fitting permanently attached to each end of said lower rail;

a cross-fitting formed of polyvinyl chloride, each end thereof having outer and inner diameters equal to the outer and inner diameters of said rails, said cross-fitting permanently attached to each end of said lower rail;

a plurality of vertical posts having outer and inner diameters equal to the outer and inner diameters of said rails, first ones of said posts each having a first end permanently attached to a vertical end of said tee fittings, and a second end of each permanently attached to a first vertical end of said cross-fittings, and second ones of said posts each having one end permanently attached to a second vertical end of each of said cross fittings; and a plurality of solid, cylindrical reinforcing joint aligners formed of polyvinyl chloride to have an outside diameter essentially equal to the inside diameter of said rails, said posts, and said fittings, one of said aligners permanently disposed within each of said fittings and extending across each joint formed by said rails, said posts, and said fittings, said joint aligners serving to align and reinforce each of said joints.

8. The railing section as defined in claim 7 which further includes a plurality of vertical closely spaced rail elements attached between said top rail and said lower rail.

9. The railing section as defined in claim 7 in which said permanent attachments are formed by chemical welding using a polyvinyl chloride solvent.

10. A security railing comprising:

(a) a plurality of horizontal rails formed of polyvinyl chloride cylindrical pipe, each of said rails having rabbeted ends thereof;

(b) a plurality of vertical posts formed of polyvinyl chloride cylindrical pipe, each of said elements having at least one rabbeted end thereof and having outer and inner diameters equal to the outer and inner diameters of said rails;

(c) a plurality of fittings having outer and inner diameters equal to the outer and inner diameters of said rails and posts, said fittings for joining said horizontal rails and said vertical posts to thereby form a security rail section; and (d) a plurality of cylindrical joint aligners formed of a solid cylinder of polyvinyl chloride, each of said aligners including a metal reinforcing bar embedded therein, and having an outside diameter equal to the inside diameter of said rails, said posts, and said fittings, one of said joint aligners disposed in and through each of said fittings to extend across each joint formed with a rail or post, said joint aligners functioning to align and reinforce each joint formed between said fittings and said rails and posts.

* * * * *